US008005241B2

(12) United States Patent
Rollins

(10) Patent No.: US 8,005,241 B2
(45) Date of Patent: Aug. 23, 2011

(54) MUTE CIRCUIT FOR A MICROPHONE

(75) Inventor: Michael Rollins, Mukilteo, WA (US)

(73) Assignee: RANE Corporation, Mukilteo, WA (US)

( * ) Notice: Subject to any disclaimer, the term of this patent is extended or adjusted under 35 U.S.C. 154(b) by 1352 days.

(21) Appl. No.: 11/548,245

(22) Filed: Oct. 10, 2006

(65) Prior Publication Data

US 2008/0095386 A1 Apr. 24, 2008

(51) Int. Cl.
*H04R 3/00* (2006.01)
*H04R 1/02* (2006.01)

(52) U.S. Cl. ..... 381/111; 381/113; 381/91; 381/122

(58) Field of Classification Search ..... 381/111–114, 381/122, 91–92; 455/556.1, 566, 575.3
See application file for complete search history.

(56) References Cited

U.S. PATENT DOCUMENTS

| | | | | |
|---|---|---|---|---|
| 5,175,759 | A * | 12/1992 | Metroka et al. | 455/569.1 |
| 5,918,188 | A * | 6/1999 | Doran | 455/575.3 |
| 6,778,814 | B2 * | 8/2004 | Koike | 455/95 |
| 2003/0064687 | A1 * | 4/2003 | Sugino et al. | 455/90 |

* cited by examiner

*Primary Examiner* — Devona E Faulk
*Assistant Examiner* — George Monikang
(74) *Attorney, Agent, or Firm* — Kevin D. Jablonski; Graybeal Jackson LLP

(57) ABSTRACT

An apparatus having a microphone and a mute circuit (not shown in detail here) operable to be actuated by a rotating door assembly. The apparatus provides a mute circuit suitable to mute the audio microphone when the rotating door assembly is in a closed position and unmute the audio microphone when the rotating door assembly is not in the closed position. Additionally, the mute circuit is impervious to generating audible disturbances in the microphone signal when the rotating assembly door is rotated between open and closed positions. This advantageously allows for the microphone to essentially transition to off when the rotating door assembly is closed and transition to on when the rotating door assembly is open and do so without additional audio disturbance.

20 Claims, 3 Drawing Sheets

MUTE CIRCUIT FOR A MICROPHONE

BACKGROUND OF THE INVENTION

Microphones are used in today's society for sound reinforcement in a number of different venues for a number of different purposes. In the past, microphones may have been limited to specific situations where a public address system or a musical performance required sound reinforcement. As microphones and sound reinforcement system have become more inexpensive and more innovative, a wider variety of situations may also benefit from sound amplification and reinforcement. As such, microphones are more and more prevalent at non-traditional locations and venues.

One venue in particular that has benefited from the increased functionality and ease of microphone use is facilities for religious services, such as churches, synagogues, mosques, temples and the like. Microphones are able to be placed at strategic locations, often hidden from view, that enhance the ability for all to hear specific individuals when speaking or singing. For example, a lavaliere microphone is able to be placed on the clothing of an individual such that everything that the individual says is picked up by the microphone and amplified through an associated sound reinforcement system. While lavaliere microphones are small and suitable for a dedicated individual to use, others may not easily use this microphone as it is typically difficult to easily pass the microphone from person to person. Thus, sometimes microphones are installed and fixed to a specific location, such as a pulpit or choir area.

As is the case with most microphones, an "on/off" switch may be provided such that the microphone may be turned on and off. When off, no sound waves are amplified and these sound waves are not converted to electrical signals. However, when on, the microphone functions as normal and converts all sound waves at the microphone into electrical signals. Some microphones employ a mute circuit which interrupts the flow of the electrical signal generated by the microphone to the rest of the sound reinforcement system. However, a typical "on/off" switch or mute switch, when actuated, causes a "pop" in the sound reinforcement system. That is, the electrical equivalent of switching the circuit on or off is a sharp and poignant transient response that is audible in the sound reinforcement system as a loud popping sound.

In one conventional example, a microphone system made by the Ivie Corporation (IM-10), a mute switch is implemented in the form of a magnetic reed switch. In this example, the magnetic switch is able to detect the proximity of a metal rotating door. The mute function of the Ivie IM-10 is achieved with a magnetic reed switch that is activated in the presents of a magnetic field. This field is achieved by attaching a rare-earth magnet to the rotating door of the microphone apparatus so that the field is present when the door is in the closed position and is absent when the door is in the open position. Thus, when the door is closed, the microphone circuit is muted, but when the door is open (i.e., the metal door is no longer in proximity to the magnetic switch) the microphone circuit is on and functioning. However, the nature of the magnetic switch allows an audible disturbance to be created in the electronic circuit. As a result, the mute circuit for the fixed location microphone apparatus causes unwanted electrical signals that are audible and undesirable in the sound reinforcement system.

BRIEF DESCRIPTION OF THE DRAWINGS

The foregoing aspects and many of the attendant advantages of the claims will become more readily appreciated as the same become better understood by reference to the following detailed description, when taken in conjunction with the accompanying drawings, wherein:

DETAILED DESCRIPTION

The following discussion is presented to enable a person skilled in the art to make and use the subject matter disclosed herein. The general principles described herein may be applied to embodiments and applications other than those detailed above without departing from the spirit and scope of the present detailed description. The present disclosure is not intended to be limited to the embodiments shown, but is to be accorded the widest scope consistent with the principles and features disclosed or suggested herein.

Figure 1:
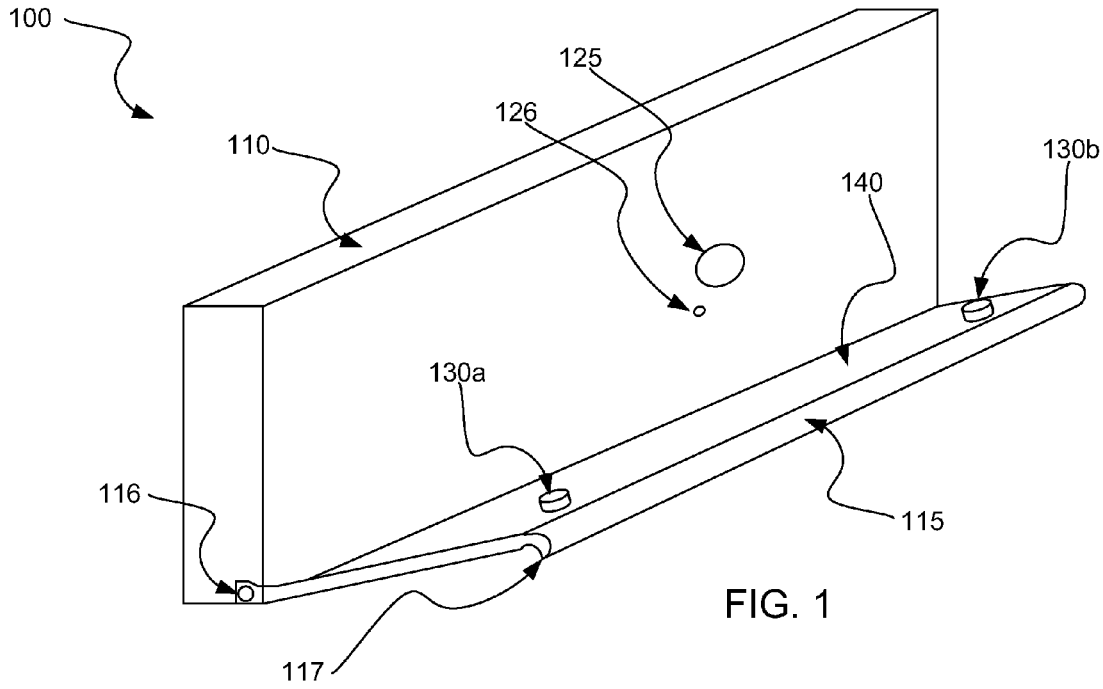
FIG. 1 shows an isometric view of a microphone apparatus having a mute circuit operable to be actuated by a rotating door assembly according to one embodiment.

FIG. 1 shows an isometric view of an apparatus 100 having a microphone 125 and a mute circuit (not shown in detail here) operable to be actuated by a rotating door assembly 115 according to one embodiment. The apparatus 100 provides a mute circuit (described below with respect to FIG. 4) suitable to mute the audio microphone 125 when the rotating door assembly 115 is in a closed position and unmute the audio microphone 125 when the rotating door assembly 115 is not in the closed position. Additionally, the mute circuit is impervious to generating audible disturbances in the microphone signal when the rotating assembly door 115 is rotated between open and closed positions. This advantageously allows for the microphone 125 to essentially be off when the rotating door assembly 115 is closed and turn on without audio disturbance when the rotating door assembly 115 is opened.

In the isometric view of FIG. 1, a housing assembly 110 is provided such that the rotating door assembly 115 is rotatably attached at pivots 116. The housing assembly 110 is of a suitable shape and size so as to allow mounting the entire apparatus 100 in a desk or table (described below with respect to FIG. 5). Such a housing assembly 110 allows for ease of mounting wherein the rotating door assembly 115 is easily accessed or engaged by a person sitting and standing at the desk or table. The rotating door assembly 115 also includes rubber stoppers 130*a* and 130*b* that prevent additional audible noise when the rotating door assembly 115 is move to the closed position. The rotating door assembly 115 also includes a curved recess 117 at its top side for ease of manipulation such that a person's fingers may easily engage the rotating door assembly 115.

An additional feature of the apparatus 100 is that the rotating door assembly 115 provides a flat surface 140 large enough to place a printed sticker or placard. Such a printed and readable textual feature may be provided for often recited communications and the like. For example, if the microphone system and apparatus 100 is often used to make announcements at a train station, specific announcement protocols may be printed on the flat surface 140 on the inside of the rotating door assembly 115. As another example, during a religious service, an often recited prayer may be printed on the flat surface 140 on the inside of the rotating door assembly 115.

As will be discussed in greater detail below, the housing assembly 110 also facilitates the mounting of the mute circuit such that a sensor 126 may sense the proximity of on the flat surface 140 on the inside of the rotating door assembly 115. The sensor 126 is typically disposed near the microphone 125 but may disposed in any suitable position to detect the position of the flat surface 140 on the inside of the rotating door assembly 115.

Figure 2:
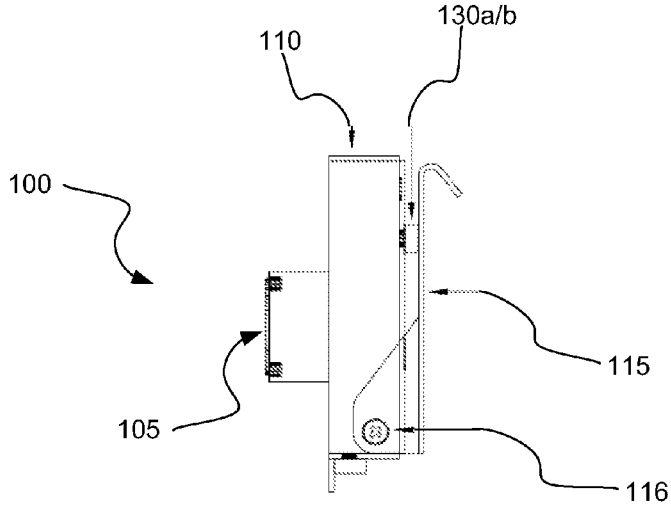
FIG. 2 shows a side view of a microphone apparatus having a mute circuit operable to be actuated by a rotating door assembly according to one embodiment.

In FIG. 1, the rotating door assembly 115 is shown at an angle that is not fully open or fully closed. In a typical embodiment, a fully closed position may be associated with a position wherein the rotating door assembly 115 is at a 0 degree angle (as shown in FIG. 2 described below) which is typically vertical. The closed position may be characterized as having rotating door assembly 115 close enough such that the sensor 126 is able to sense its proximity. When fully open, the rotating door assembly 115 is at a 90 degree angle which is typically horizontal. The open position may be characterized as having rotating door assembly 115 far enough away such that the sensor 126 is no longer able to sense its proximity. As a result, the rotating door assembly 115 is operable to rotate 90 degrees such that the closed position that engages the microphone mute circuit is associated with a range of motion beginning at a 0 degree position and that the open position that disengages the microphone mute circuit is associated with a range of motion ending at a 90 degree position.

Previous embodiments of this type of microphone apparatus are not realizable with modern manufacturing techniques. Conventional embodiments used a magnetic switch that required affixing a magnetic reed switch with an adhesive and a magnet affixed to the door also with an adhesive. This embodiment allows a microphone to be assembled without any adhesives at all. Additionally, the components used in this invention are readily available in packages that can be assembled using surface-mount printed circuit board assembly techniques. This avoids the many labor-intensive manual operations that were required for previous embodiments.

FIG. 2 shows a side view of a microphone apparatus 100 having a mute circuit operable to be actuated by a rotating door assembly 115 according to one embodiment. Again, the housing assembly 110 is rotatably attached to the rotating door assembly 115 at pivots 116. Rubber stoppers 130*a* and 130*b* engage the housing assembly 110 when the rotating door assembly 115 is closed. As mentioned above, the rotating door assembly 115 is in the closed position (i.e., 0 degrees) such that the sensor 126 (not shown in FIG. 2) senses the rotating door assembly 115 and mutes the microphone circuit. FIG. 2 also shows a typical XLR connector 105 at the rear of the housing assembly 110.

Figure 3:
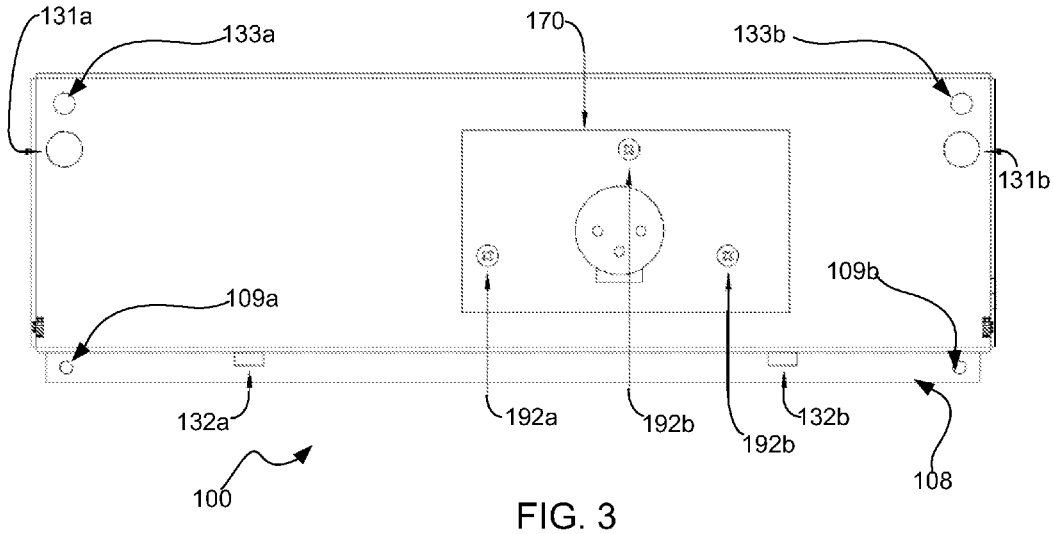
FIG. 3 shows a rear view of a microphone apparatus having a mute circuit operable to be actuated by a rotating door assembly according to one embodiment.

FIG. 3 shows a rear view of a microphone apparatus 100 having a mute circuit operable to be actuated by a rotating door assembly 110 according to one embodiment. Housing assembly 110 is shown with additional features that include more rubber stoppers suitable to prevent any additional audible noise from being picked up by the microphone circuit. Such additional rubber gasket stoppers include interior stoppers 131*a* and 131*b* and housing assembly 110 base stoppers 132*a* and 132*b*. Additionally mounting eyeholes 133*a* and 133*b* are provided in the housing assembly such that the apparatus 100 may be easily mounted to a desk or table. Mounting flange 108 with eyeholes 109*a* and 109*b* further facilitates mounting of the apparatus 100.

In this view, the mute circuit 170 can be seen as mounted to the housing assembly 110 via screws 192*a*, 102*b*, and 192*c*. The mute circuit 170 may typically be a printed circuit board, but alternatively may be any suitable electronic circuit realization such as wire-wrap or integrated circuit. These additional embodiments will not be described herein. The mute circuit 170 includes a microphone (unable to be seen in FIG. 4) as well as an XLR connector 105.

Figure 4:
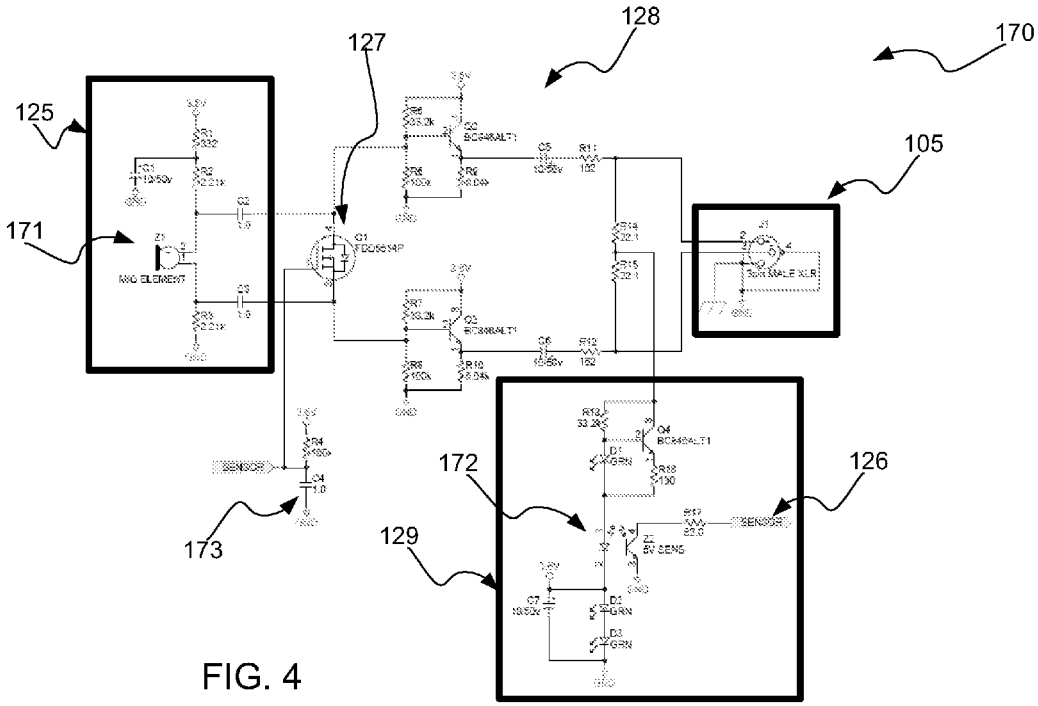
FIG. 4 shows an electrical circuit having a mute circuit according to one embodiment.

FIG. 4 shows an electrical schematic of a circuit 170 for muting a microphone according to one embodiment. In this embodiment, an infrared switch circuit 129 is coupled to other components of the circuit 170 to detect the position of a rotating door assembly 115 (not shown in this schematic). The infrared switch circuit 129 (which includes sensor 126) includes a continuous, unmodulated infrared source and an infrared detector (e.g., sensor 126) for sensing the proximity of the rotating door assembly 115. As discussed before, when the sensor 126 detects the proximity of rotating door assembly 115, the mute circuit 128 is engaged. The mute circuit 128 includes a microphone mute transistor 127 that may be a Field Effect Transistor (FET) that electrically mutes a microphone element 171. The mute circuit 128 also includes passive elements, such as resistors and capacitors (as shown, but not referenced) that provide time constants for operation of the mute circuit 128 that is free from audible switching disturbances.

The circuit 170 is designed to operate from microphone phantom power. The circuit 170 also includes power conservation techniques to provide circuit operation over a wide range of available phantom power voltages. In this embodiment, an eight mA current source comprises elements Q4, D1, R13, and R15 that are collectively in series with an IR source Z2 and the voltage source of D2, D3 and C7 so that a current budget of eight mA provides power for every part of circuit 170. R14 and R16 are a minimum value to minimize voltage drop at that part of the circuit. The total voltage drop of resistors R14 and R16, the current source, the IR source Z2 and the voltage source is 6.8 volts thus insuring proper operation from phantom power sources of as little as 10 volts sourced through 800 ohm resistors. Maximum phantom power voltage is limited by DC blocking capacitors C5 and C6 to 50 volts. Thus, the circuit 170 is designed to operate properly over a phantom supply range or 10 volts minimum to 50 volts maximum.

The operation of the circuit 170 typically includes methods for engaging and disengaging the mute circuit 128 according to the proximity of the rotating door assembly 115. In one embodiment, an infrared diode 172 receives power from a constant current source generating a continuous-wave infrared source that illuminates a target on the rotating door assembly 115. The presence or absence of a reflection from the target determines if a door is in the closed position. The current source provides power to the infrared diode 172. If there is too little current then there may be insufficient illumination of the target. If there is too much current then the infrared diode 172 may burn up. Additionally, at higher current levels, unintentional targets may be illuminated, such as people or other relatively distant objects.

When the rotating door assembly 115 is in the closed position, a mute switch 127 that is in parallel with the microphone element 171. The microphone mute transistor 127 may typically be an FET transistor that is electrically coupled to the infrared switch circuit 129. When the infrared switch circuit 129 is engaged (i.e., the sensor senses the proximity of the rotating assembly door 115) enough current is produced to cause the gate of a "P" channel of the microphone mute transistor 127 to be in a low impedance condition. When the microphone mute transistor 127 is in a low impedance state, the audio signal level of the microphone element 171 is attenuated sufficiently to be muted. This electrical process happens with sufficient rapidity such that the mute circuit 128 is engaged before the rotating door assembly 115 can be fully closed.

When the rotating door assembly 115 is opened, the electrical process reverses. The gate charge of the microphone mute transistor 127 is depleted through a first-order passive filter 173, which delays the release of the mute condition until after the rotating door assembly 115 is opened. The mute circuit 128 is released gradually effectively ramping the audio signal output of the microphone toward an on condition.

In an alternative embodiment, the infrared diode 172 may be driven from a modulated source. In this case, a discriminator (not shown) may be added after the infrared diode 172 to increase the sensitivity and selectivity of the system per common practice in communication systems. As the circuit 170 uses continuous wave infrared light, other sources of such radiation may cause the system to malfunction. Examples include common sun light and the like, As such, the intended environment for this circuit 170 is typically free of such contaminating sources.

Figure 5:
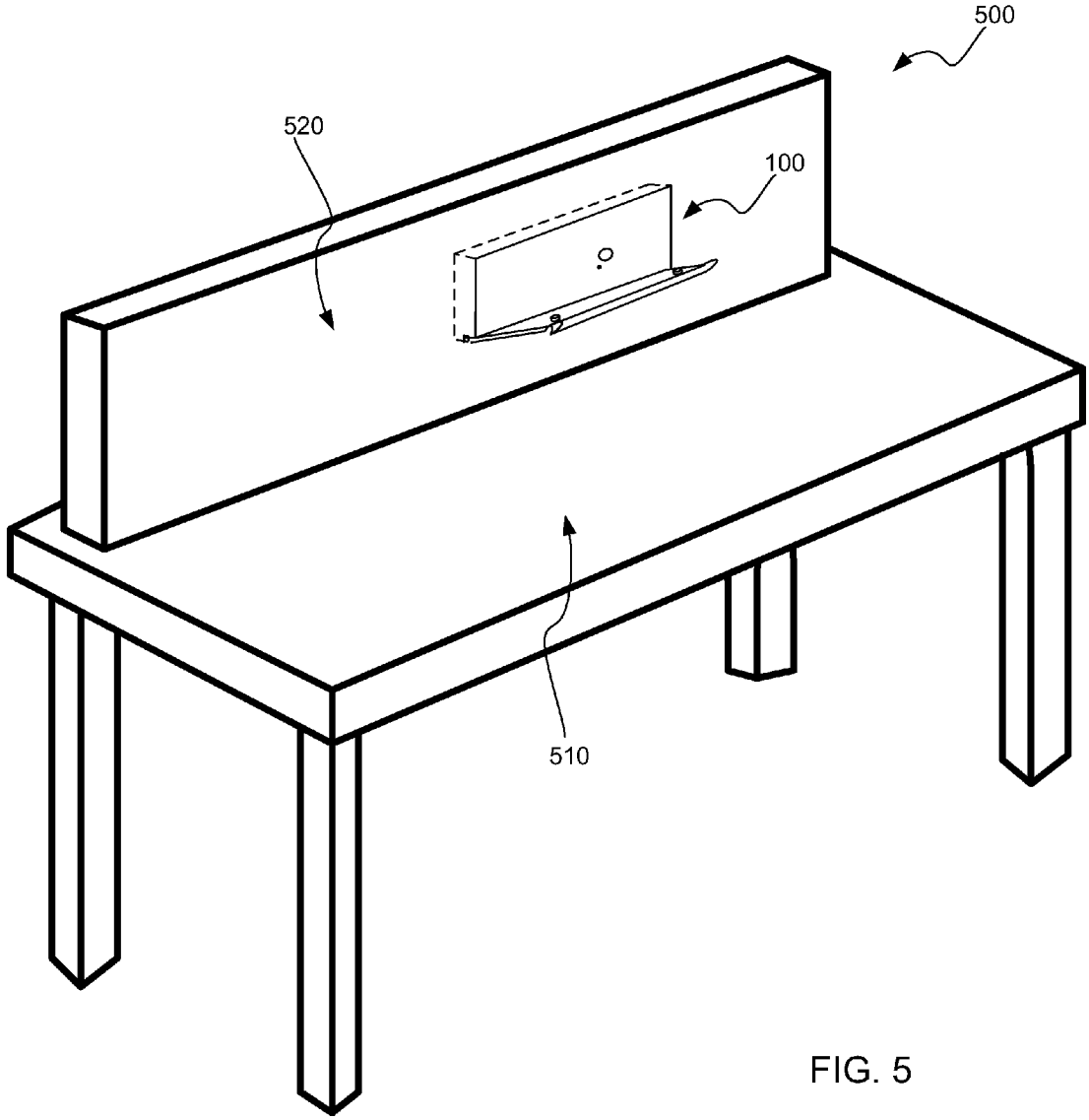
FIG. 5 shows an isometric view of a system for employing the microphone apparatus of FIGS. 1-3 according to one embodiment.

FIG. 5 shows an isometric view of a system for employing the microphone apparatus of FIGS. 1-3 according to one embodiment. In this embodiment, table 500 includes a flat surface 510 and backdrop 520 that is formed to host the microphone apparatus 100 of FIGS. 1-3. Such a system provides a suitable location wherein a user of the microphone apparatus 100 may easily rotate the rotating door assembly open and closed while stationed at the table 500. Thus, the user may engage and disengage the mute circuit of the apparatus 100 easily and without electrical or audio disturbances. Other embodiments may comprise having the microphone apparatus 100 disposed in the lower front area of the table 500, i.e., where a typical center drawer may be located.

While the subject matter discussed herein is susceptible to various modifications and alternative constructions, certain illustrated embodiments thereof are shown in the drawings and have been described above in detail. It should be understood, however, that there is no intention to limit the claims to the specific forms disclosed, but on the contrary, the intention is to cover all modifications, alternative constructions, and equivalents falling within the spirit and scope of the claims.

What is claimed is:

1. An electronic circuit, comprising:

a microphone operable to transform a sound wave into an electrical signal;

a current source electrically coupled to the microphone and operable to provide phantom power to the microphone;

an infrared diode electrically coupled to the current source and operable to focus infrared light away from the microphone;

an infrared detection phototransistor electrically coupled to the current source and operable to detect infrared light reflected from an illuminated target; and a muting transistor electrically coupled to the infrared detection transistor and the microphone and operable to attenuate the electrical signal from the microphone when the infrared detection transistor detects infrared light.

2. The electrical circuit of claim 1 wherein the muting transistor comprises a p-channel field effect transistor having a gate coupled to the source of the infrared detection phototransistor.

3. The electrical circuit of claim 1 wherein the infrared diode comprises a continuous, unmodulated infrared source.

4. The electrical circuit of claim 1, further comprising a passive filter coupled to the muting transistor, the passive filter operable to dissipate voltage from the gate of the muting transistor.

5. The electrical circuit of claim 1 wherein the current source comprises a current source designed to provide a phantom supply voltage over a range of 10 volts minimum to 50 volts maximum.

6. The electrical circuit of claim 1 wherein the muting transistor is biased such that when the muting transistor is in a low impedance state, the audio signal level of the microphone element is attenuated sufficiently to be muted.

7. The electrical circuit of claim 1 wherein the muting transistor is biased such that when a voltage at the gate of the muting transistor is depleted through a first-order passive filter, the audio is released gradually from being muted effectively ramping the audio signal output of the microphone toward an on condition.

8. An apparatus comprising:

a microphone operable to transform a sound wave into an electrical signal, the microphone mounted to a microphone housing;

a current source electrically coupled to the microphone and operable to provide phantom power to the microphone;

an infrared diode electrically coupled to the current source and operable to focus infrared light away from the microphone;

an infrared detection phototransistor electrically coupled to the current source and operable to detect infrared light reflected from an illuminated target;

a muting transistor electrically coupled to the infrared detection transistor and the microphone and operable to attenuate the electrical signal from the microphone when the infrared detection transistor detects infrared light; and a rotating door assembly that is rotatably attached to the microphone housing such that the rotating door assembly may be rotated to a first position to engage the microphone mute circuit and rotated to a second position to disengage the microphone mute circuit.

9. The apparatus of claim 8 wherein the microphone mute circuit further comprises an optical switch operable to sense the proximity of the microphone cover plate.

10. The apparatus of claim 9 wherein the optical switch further comprises an infrared light source operable to focus infrared light in a first direction away from the microphone and an infrared light detector operable to detect infrared light reflected back toward the microphone.

11. The apparatus of claim 10 wherein the rotating door assembly further comprises an infrared light reflecting surface operable to reflect infrared light toward the infrared light detector when the rotating door assembly is rotated to the first position and operable to not reflect infrared light toward the infrared detector when the rotating door assembly is rotated to the second position.

12. The apparatus of claim 8 wherein the rotating door assembly is operable to rotate 90 degrees such that the first position that engages the microphone mute circuit is associated with a range of motion beginning at a 0 degree position.

13. The apparatus of claim 8 wherein the rotating door assembly is operable to rotate 90 degrees such that the second position that disengages the microphone mute circuit is associated with a range of motion ending at a 90 degree position.

14. The apparatus of claim 8 wherein the rotating door assembly is operable to contain readable text corresponding to recitations to be recited into the microphone.

15. The apparatus of claim 8 wherein the microphone mute circuit is operable to be engaged and disengaged without causing unintentional audio disturbances to the electrical signal generated from the sound wave.

16. The apparatus of claim 8 wherein the microphone comprises a condenser microphone suitable to be powered by phantom power provided via an XLR connector.

17. A system comprising:

an audio device, including:

a microphone operable to transform a sound wave into an electrical signal, the microphone mounted to a microphone housing;

a current source electrically coupled to the microphone and operable to provide phantom power to the microphone;

an infrared diode electrically coupled to the current source and operable to focus infrared light away from the microphone;

an infrared detection phototransistor electrically coupled to the current source and operable to detect infrared light reflected from an illuminated target;

a muting transistor electrically coupled to the infrared detection transistor and the microphone and operable to attenuate the electrical signal from the microphone when the infrared detection transistor detects infrared light; and a rotating door assembly that is rotatably attached to the microphone housing such that the rotating door assembly may be rotated to a first position to engage the microphone mute circuit and rotated to a second position to disengage the microphone mute circuit;

an audio device housing operable to house the audio device and operable to be securably attached to a platform; and a table having a flat work area and a vertical platform area, the platform area forming the platform to which the audio device housing may be securably attached.

18. The system of claim 17 wherein the microphone cover plate assembly includes a readable text corresponding to recitations to be recited into the microphone by an operator when the rotating door assembly is rotated to an open position.

19. The system of claim 17 wherein audio device housing further comprises rubber stoppers operable to provide a securable fitting for the audio device housing when inserted into the table.

20. The system of claim 17 wherein microphone rotating door assembly further comprises rubber stoppers operable to engage the audio device housing such that the rotating door assembly is prevented from contacting the audio device housing when rotated to a closed position.

* * * * *